US012497866B2

(12) United States Patent
Chevallier et al.

(10) Patent No.: US 12,497,866 B2
(45) Date of Patent: Dec. 16, 2025

(54) EXPANDABLE LINER HANGER WITH ROBUST SLIPS FOR DOWNHOLE CONDITIONS WITH HIGH PRESSURE CONDITIONS

(71) Applicant: Halliburton Energy Services, Inc., Houston, TX (US)

(72) Inventors: Francois Chevallier, Singapore (SG); Yian Zhao, Singapore (SG); Chee Sing Kelvin Loh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/543,925

(22) Filed: Dec. 18, 2023

(65) Prior Publication Data

US 2024/0229614 A1 Jul. 11, 2024

Related U.S. Application Data

(60) Provisional application No. 63/438,191, filed on Jan. 10, 2023.

(51) Int. Cl.
*E21B 43/10* (2006.01)

(52) U.S. Cl.
CPC ..... *E21B 43/103* (2013.01)

(58) Field of Classification Search
CPC ..... E21B 43/103
See application file for complete search history.

(56) References Cited

U.S. PATENT DOCUMENTS

| | | | |
|---|---|---|---|
| 2,152,628 | A | 4/1939 | Gauthey et al. |
| 4,663,513 | A | 5/1987 | Webber |
| 4,832,125 | A | 5/1989 | Taylor |
| 4,919,460 | A | 4/1990 | Milberger et al. |
| 5,303,518 | A | 4/1994 | Strickland |
| 5,542,473 | A | 8/1996 | Pringle et al. |
| 6,029,748 | A | 2/2000 | Forsyth et al. |
| 6,098,717 | A | 8/2000 | Bailey et al. |

(Continued)

FOREIGN PATENT DOCUMENTS

| | | | |
|---|---|---|---|
| EP | 0289108 A2 | 11/1988 | |
| EP | 2789791 A1 * | 10/2014 | ..... E21B 29/10 |

(Continued)

OTHER PUBLICATIONS

Dril-Quip. "TIW XPak® Expandable Liner Hanger" Company Website, https://www.tiwoiltools.com/xpak-liner-hanger.html. Accessed Dec. 11, 2023. PDF file. 6 pages.

(Continued)

*Primary Examiner* — Jennifer H Gay
(74) *Attorney, Agent, or Firm* — Scott Richardson; C. Tumey Law Group PLLC

(57) ABSTRACT

In general, in one aspect, embodiments relate to an expandable liner hanger that includes a body that includes one or more anchoring ridges configured to seal against a casing, where at least one of the one or more anchoring ridge includes a first section and a second section, where a first axial distance spanned by the first section is less than a second axial distance spanned by the second section, and where the second section is reinforced to resist differential pressure that reduces contact pressure between the first section and the casing.

17 Claims, 4 Drawing Sheets

(56) References Cited

U.S. PATENT DOCUMENTS 6,378,606 B1 4/2002 Swor et al.
6,793,022 B2 9/2004 Vick et al.
7,360,592 B2 * 4/2008 McMahan ..... E21B 43/106 166/380
9,255,467 B2 2/2016 Thomson et al.
9,316,084 B2 4/2016 Carter et al.
9,580,981 B2 2/2017 Zhong et al.
9,695,651 B2 * 7/2017 Gorrara ..... E21B 43/108
9,752,400 B2 * 9/2017 Hazelip ..... E21B 33/0422
10,151,168 B2 * 12/2018 Hallundbæk ..... E21B 43/103
10,337,298 B2 7/2019 Braddick
11,118,434 B2 * 9/2021 Hazelip ..... E21B 23/01
11,156,065 B2 * 10/2021 Zhong ..... E21B 43/106
11,225,000 B2 1/2022 Yu et al.
11,248,450 B2 * 2/2022 Hazelip ..... E21B 33/10
11,248,451 B2 2/2022 Sevadjian et al.
11,359,465 B2 * 6/2022 Williams ..... E21B 43/103
12,134,956 B2 * 11/2024 Zhong ..... E21B 33/04
12,252,961 B2 * 3/2025 Zhong ..... E21B 43/10
2001/0045289 A1 11/2001 Cook et al.
2001/0047866 A1 12/2001 Cook et al.
2002/0014339 A1 2/2002 Ross
2002/0139540 A1 10/2002 Lauritzen
2003/0042022 A1 3/2003 Lauritzen et al.
2003/0047322 A1 3/2003 Maguire et al.
2003/0094768 A1 5/2003 Kamiya et al.
2004/0149418 A1 8/2004 Bosma et al.
2004/0244994 A1 12/2004 Jackson et al.
2005/0011650 A1 1/2005 Harrall et al.
2005/0052019 A1 3/2005 Schroeder
2006/0237188 A1 * 10/2006 McMahan ..... E21B 23/01 166/207
2007/0257486 A1 11/2007 Filippov et al.
2012/0097384 A1 4/2012 Valencia et al.
2012/0205091 A1 8/2012 Turley et al.
2012/0312542 A1 12/2012 Varghese et al.
2013/0248209 A1 9/2013 Watson
2014/0000911 A1 * 1/2014 Gorrara ..... E21B 19/16 166/207
2014/0008082 A1 * 1/2014 O'Brien ..... E21B 43/103 166/242.6
2014/0020911 A1 1/2014 Martinez
2014/0174763 A1 6/2014 Zhong et al.
2015/0068733 A1 3/2015 Dilber et al.
2015/0218903 A1 8/2015 Sellers, Jr. et al.
2016/0053591 A1 2/2016 Hallundbaek et al.
2016/0090801 A1 * 3/2016 Hazelip ..... E21B 43/10 166/382
2016/0326830 A1 * 11/2016 Hallundbæk ..... E21B 33/1208
2016/0356131 A1 12/2016 Humphrey et al.
2016/0369587 A1 12/2016 Staehr
2017/0022775 A1 1/2017 Spitz et al.
2018/0045016 A1 2/2018 Radtke et al.
2018/0112486 A1 4/2018 Potts et al.
2018/0135369 A1 5/2018 Parekh et al.
2019/0218873 A1 7/2019 Davis et al.
2019/0316434 A1 10/2019 Davies et al.
2019/0330943 A1 10/2019 Givens et al.
2020/0149375 A1 5/2020 Bermudes et al.
2020/0173248 A1 6/2020 Yee et al.
2020/0332604 A1 * 10/2020 Whiddon ..... E21B 17/04
2020/0370383 A1 * 11/2020 Hazelip ..... E21B 43/105
2021/0010353 A1 * 1/2021 Hazelip ..... E21B 23/01
2021/0011576 A1 1/2021 Suto et al.
2021/0087902 A1 3/2021 Saeed
2021/0115764 A1 * 4/2021 Zhong ..... E21B 23/01
2021/0140263 A1 5/2021 Dockweiler et al.
2021/0310339 A1 * 10/2021 Williams ..... E21B 43/106
2022/0145712 A1 5/2022 Bermudez et al.
2023/0003097 A1 1/2023 Vasques
2023/0220743 A1 * 7/2023 Vasques ..... E21B 43/103 166/387
2023/0349270 A1 * 11/2023 Furlong ..... E21B 43/105
2023/0374890 A1 * 11/2023 Zhong ..... E21B 43/10
2023/0407730 A1 * 12/2023 Zhong ..... E21B 43/108
2024/0117716 A1 4/2024 Zhong et al.
2024/0151123 A1 * 5/2024 Loh ..... E21B 43/103
2024/0175332 A1 5/2024 Silverberg et al.
2024/0229614 A1 * 7/2024 Chevallier ..... E21B 43/103

FOREIGN PATENT DOCUMENTS

EP 3667014 A1 * 6/2020 ..... E21B 33/1208
WO 2011151139 A1 12/2011
WO 2020185208 A1 9/2020

OTHER PUBLICATIONS

International Search Report and Written Opinion for International Patent Application No. PCT/US2023/086224 dated May 8, 2024. PDF file. 8 pages.

* cited by examiner

EXPANDABLE LINER HANGER WITH ROBUST SLIPS FOR DOWNHOLE CONDITIONS WITH HIGH PRESSURE CONDITIONS

CROSS-REFERENCE TO RELATED APPLICATIONS

The present application is a non-provisional of U.S. Provisional Application No. 63/438,191, filed Jan. 10, 2023, the entire disclosure of which is incorporated herein by reference.

BACKGROUND

During wellbore operations, it is typical to "hang" a liner onto a casing such that the liner supports an extended string of tubular below it. As used herein, "tubing string" refers to a series of connected pipe sections, casing sections, joints, screens, blanks, cross-over tools, downhole tools, and the like, inserted into a wellbore, whether used for drilling, work-over, production, injection, completion, or other processes. A tubing string may be run in and out of the casing, and similarly, tubing string can be run in an uncased wellbore or section of wellbore. Further, in many cases a tool may be run on a wireline or coiled tubing instead of a tubing string, as those of skill in the art will recognize.

An expandable liner hanger may generally be used to secure the liner within a previously set wellbore tubular (e.g., casing or liner string). Expandable liner hangers may be "set" by expanding the liner hanger radially outward into gripping and sealing contact with the wellbore tubular. For example, expandable liner hangers may be expanded by use of hydraulic pressure to drive an expanding cone, wedge, or "pig," through the liner hanger. Other methods may be used, such as mechanical swaging, explosive expansion, memory metal expansion, swellable material expansion, electromagnetic force-driven expansion, etc. Often, there are spikes on the outer side of the liner hanger which bite onto the wall of casing upon expansion/swaging, creating a high contact pressure interface which may seal off the pressures either from the top or bottom of the hanger.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to expandable liner hangers. Specifically, the present disclosure relates to anchoring ridges which are reinforced to prevent dislodgement from casing. More specifically, stiffening of select regions of a body of the expandable liner hangers increases the amount of pressure required to penetrate the sealing interface between the hanger and casing. Likewise, this increases the local contact pressure in each anchoring ridge, improving the metal-to-metal (MTM) sealing performance of the expandable liner hanger.

In geothermal wells, the body near anchoring ridges of an expandable liner hanger may be subjected to well pressures. The thickness of the body is directly proportional to the strength of the hanger, and high pressures shrink the hanger body and expand the casing. This causes separation between the hanger spike and casing inner wall, ultimately reducing the contact pressures between them. The amount of contact pressure directly influences the sealing capability of the anchoring ridges. Therefore, a drop in contact pressure leads to poor sealing, which is important for the expandable liner hanger to operate reliably.

To address the sealing issues, various examples of anchoring ridges are disclosed. For example, an expandable liner hanger of the present disclosure may include a first section and a second section. The second section may be more resistant to strain to prevent the anchoring ridges from pulling away from the casing. Wider anchoring ridges may be implemented to allow for the different sections. Also, some spikes may include at least two steps. In another example, an anchoring ridge may be entirely flat and wide. In another example, an anchoring ridge may comprise a sealing spike (primary spike) which may be followed by a series of reinforcement spikes (secondary spikes).

Figure 1:
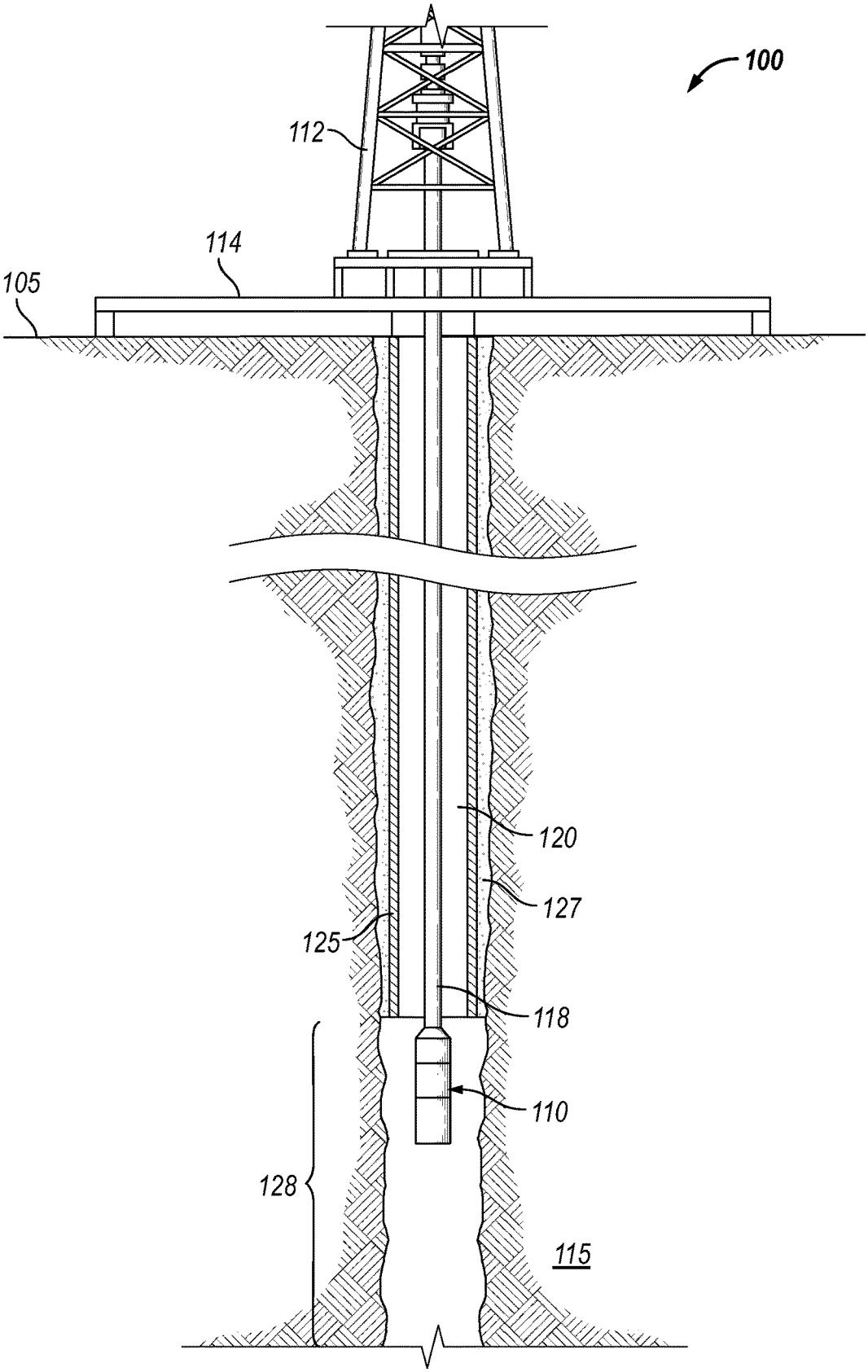
FIG. 1 illustrates an operating environment for an expandable liner hanger, in accordance with one or more examples of the present disclosure.

FIG. 1 illustrates a well system 100 for an expandable liner hanger 110, in accordance with examples of the present disclosure. Well system 100 includes an expandable liner hanger (expandable liner hanger). A derrick 112 with a rig floor 114 is positioned on the earth's surface 105. A wellbore 120 is positioned below the derrick 112 and the rig floor 114 and extends into a subterranean formation 115. The wellbore 120 may be lined with casing 125 that is cemented in place with cement 127. Although FIG. 1 depicts the wellbore 120 having a casing 125 being cemented into place with cement 127, the wellbore 120 may include open hole portion 128. Moreover, the wellbore 120 may be an open-hole wellbore. The well system 100 may equally be employed in vertical and/or deviated wellbores. It should be noted that while well system 100 generally depicts a land-based operation, those skilled in the art will readily recognize that the principles described herein are equally applicable to subsea operations that employ floating or sea-based platforms and rigs, without departing from the scope of the disclosure.

A conveyance 118 extends from the derrick 112 and the rig floor 114 downwardly into the wellbore 120. The conveyance 118 may be any mechanical connection to the surface, such as, for example, wireline, slickline, jointed pipe, or coiled tubing. As depicted, the conveyance 118 suspends the expandable liner hanger 110 for placement into the wellbore 120 at a desired location to perform a specific downhole operation. In some examples, conveyance 118 may tether to a vehicle via one or more sheave wheels, which may rotate to lower and/or raise conveyance 118 downhole. In some examples, conveyance may provide mechanical suspension, as well as electrical connectivity, for expandable liner hanger 110. In examples, expandable liner hanger 110 may be disposed about a downhole tool. A downhole tool may be any suitable downhole configured to perform a well completions operation and/or to obtain measurements while downhole. Information, such as measurements, from a downhole tool may be relayed to an information handling system at the surface.

As illustrated, expandable liner hanger 110 may be disposed in a wellbore 120 by way of conveyance 118. Wellbore 120 may extend from a wellhead into a subterranean formation 115 from surface 105. Wellbore 120 may be cased and/or uncased. In examples, wellbore 120 may comprise a metallic material, such as a tubular string. By way of example, tubular string may be a casing, liner, tubing, or other elongated tubular disposed in wellbore 120. As illustrated, wellbore 120 may extend through subterranean formation 115. Wellbore 120 may generally extend vertically into the subterranean formation 115. However, wellbore 120 may extend at an angle through subterranean formation 115, such as horizontal and slanted wellbores. For example, although wellbore 120 is illustrated as a vertical or low inclination angle well, high inclination angle or horizontal placement of the well and equipment may be possible. It should further be noted that while FIG. 1 generally depicts a land-based operation, those skilled in the art may recognize that the principles described herein are equally applicable to subsea operations that employ floating or sea-based platforms and rigs, without departing from the scope of the disclosure.

In examples, derrick 112 includes a load cell (not shown) which may determine the amount of pull on conveyance 118 at surface 105 of wellbore 120. While not shown, a safety valve may control the hydraulic pressure that drives a drum e.g., on vehicle, which may reel up and/or release conveyance 118 which may move expandable liner hanger 110 up and/or down wellbore 120. The safety valve may be adjusted to a pressure such that a drum imparts a small amount of tension to conveyance 118 over and above the tension necessary to retrieve conveyance 118 and/or expandable liner hanger 110 from wellbore 120. The safety valve may typically be set a few hundred pounds above the amount of desired safe pull on conveyance 118 such that once that limit is exceeded, further pull on conveyance 118 may be prevented. As can be appreciated, liner hangers (e.g., expandable liner hanger 110) should support the substantial weight of the attached tubing string below. For deep and extra-deep wells, subsea wells, etc., the tubing string places substantial axial load on the hanging mechanism engaging the liner hanger to the casing.

In operation, expandable liner hanger 110 may be lowered to a target depth in a run-in-hole (RIH) configuration and upon reaching the target depth, a body of the expandable liner hanger 110 may be expanded to allow spikes to bite into the sides of casing 125. This allows the expandable liner hanger 110 to be securely attached to the wellbore at the target depth in a set configuration. The spikes may be made of any suitable steel grade, aluminum, or other ductile material. In addition to spikes, expansion of the body of the expandable liner hanger 110 may in some examples, also cause one or more annular seals disposed about the expandable liner hanger 110 to engage the sides of the casing 125. Where used, such annular seals may be made of rubber, polymer, elastomer, or other suitable material. As used herein, the terms "tubular," "liner," and "casing" are used generally to describe tubular wellbore items, used for various purposes in wellbore operations. Tubulars, liners, and casings can be made from various materials (metal, plastic, composite, etc.), can be expanded or unexpanded as part of an installation procedure, and can be segmented or continuous. It is not necessary for a tubular, liner or casing to be cemented into position. Any type of tubular, liner, or casing may be used in keeping with the principles of the present disclosure.

Figure 2:
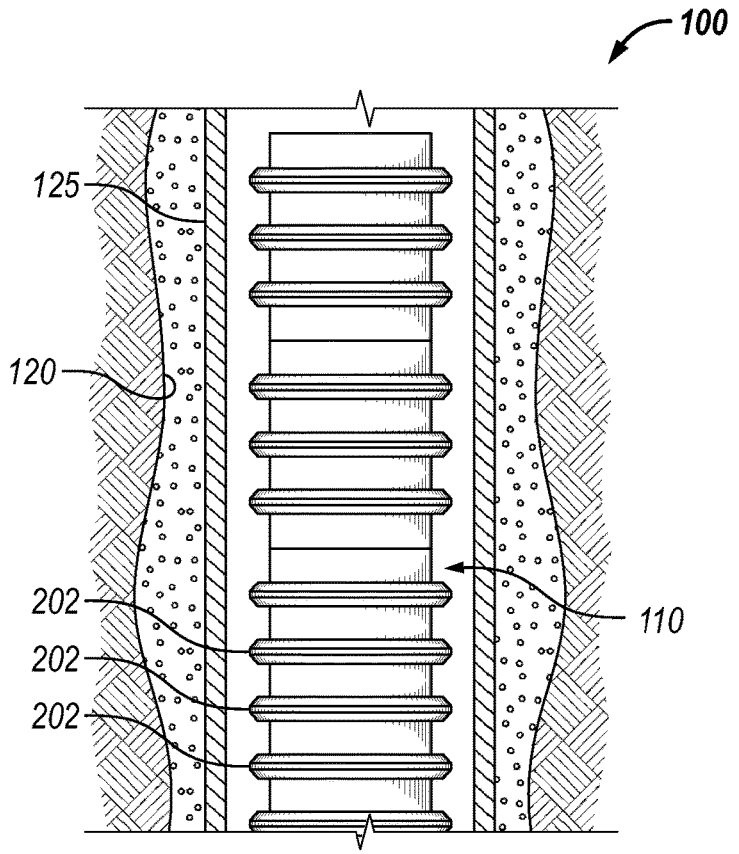
FIG. 2 illustrates an expandable liner hanger having a plurality of anchoring ridges, in accordance with one or more examples of the present disclosure.

In FIG. 2, expandable liner hanger 110 is illustrated in the well system 100 with a plurality of anchoring ridges 202 positioned on and attached to expandable liner hanger 110. In examples, when expandable liner hanger 110 may be expanded, such as with an expansion cone, discussed below, into anchoring and sealing engagement with casing 125, the plurality of anchoring ridges 202 engage the interior of casing 125. It should be noted that in examples, rubber elements may be used in conjunction with anchoring ridges 202. However, in a geothermal well, expandable liner hanger 110 may experience swings in temperature, specifically, increases in temperature during geothermal well operations which may be detrimental to maintaining contact between expandable liner hanger 110 and casing 125. This may be due to fluid expansion exerting a force on expandable liner hanger 110. For example, the body of expandable liner hanger 110 and anchoring ridges 202 may confine and trap fluid against casing 125. As temperatures fluctuate and rise in a geothermal well, the fluid may expand, which may push against casing 125, expandable liner hanger 110, and anchoring ridges 202.

Without limitation, anchoring ridges 202 may be metal spikes. The metal spikes may be made of any suitable steel grade, aluminum, any other ductile material, and a combination thereof. In certain exemplary embodiments, the spikes may be made from a combination of one or more of the recited materials. In certain embodiments, anchoring ridges 202 may be made from AISI4140 steel or AISI4340 steel. In examples, each anchoring ridge 202 may be a circular ring that extends along an outer perimeter of expandable liner hanger 110 at a desired axial location. However, the present disclosure is not limited to this particular configuration of anchoring ridges 202. For instance, in certain embodiments, anchoring ridges 202 may extend along an axial direction of expandable liner hanger 110. Moreover, in certain implementations, different anchoring ridges 202 may have different surface geometries without departing from the scope of the present disclosure. Specifically, a first spike may extend along an outer perimeter of expandable liner hanger 110 at a first axial position along expandable liner hanger 110 and a second spike may extend along an outer perimeter of expandable liner hanger 110 at a second axial position along expandable liner hanger 110. It should also be understood that many different configurations and relative positions of expandable liner hanger 110 and casing 125 are possible. For example, expandable liner hanger 110 may be alternatively anchored above a window (not shown) formed through a sidewall of casing 125, with expandable liner hanger 110 extending outwardly through the window into a branch or lateral wellbore.

In examples, anchoring ridges 202 may be formed by machining the body of expandable liner hanger 110. However, the present disclosure is not limited to machined spikes. Without limitation, any suitable methods may be used to form anchoring ridges 202. For instance, in examples, anchoring ridges 202 may be formed as a separate structure that may be coupled to expandable liner hanger 110 using any suitable coupling mechanisms. Moreover, any number of anchoring ridges 202 may be formed along the axial direction of expandable liner hanger 110. The number of anchoring ridges 202 formed along the axial direction of expandable liner hanger 110 may depend upon a number of factors such as, for example, a desired anchor load. The anchoring ridges 202 may have a minimum yield strength of at least 175 ksi, if not at least 200 ksi, if not at least 250 ksi, or up to 300 ksi or above, in some examples. In some examples, the anchoring ridges 202 may have sufficient hardness to withstand the compressive force exerted thereon during expansion and setting of the expandable liner hanger 110.

Accordingly, each of anchoring ridges 202 provides a metal-to-metal contact between expandable liner hanger 110 and casing 125. The metal-to-metal contact ultimately enables the anchoring ridges 202 to support a load applied thereto by virtue of sealing against the casing 125 with the anchoring ridges 202. The load may comprise, to use non-limiting examples, additional wellbore casing, operational tubulars, tubular strings, completion strings, downhole tools, wireline, or other conveyance, etc. Advantageously, the features disclosed herein with respect to the specific geometries, make-up, and configuration of the anchoring ridges 202 and reinforcement of the expandable liner hanger 110 may allow the expandable liner hanger 110 address contact failure problems and thereby allow the expandable liner hanger 110 to more secure and reliable anchor to the casing 125.

Figure 3:
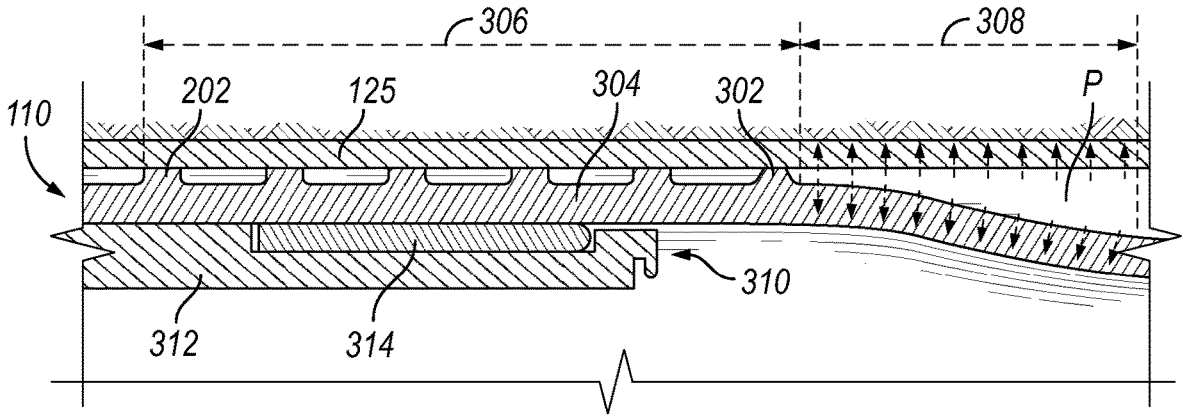
FIG. 3 illustrates a close-up view of an expandable liner hanger disposed in a casing, in accordance with one or more examples of the present disclosure.

FIG. 3 illustrates a close-up view of the expandable liner hanger 110 disposed in the casing 125, in accordance with examples of the present disclosure. In this example, the anchoring ridges 202 comprise spikes 302 extending radially outward from a body 304 of the expandable liner hanger 110. The spikes 302 are positioned along a circumference of the body 304. The body 304 includes a first section 306 that includes the spikes 302, and a second section 308 adjacent (e.g., downhole) to the first section 204 that does not include spikes. The second section 308 is subjected to well pressures P. Well pressures P in this context refers to the fluid pressure resulting from fluid trapped between body 304 and casing 125 in geothermal operations. The fluids may expand as a result of the high pressure high temperature (HPHT) conditions of the wellbore. Since the material strength of the body 304 of the expandable liner hanger 110 is directly proportional to its thickness, well pressures P will cause the body 304 at the second section 308 to shrink while expanding casing 125. This poses the potential problem of causing separation between an anchoring ridge and the inner wall of casing 125 by reducing the contact pressure and thus leading to poor sealing—an important factor for reliability of expandable liner hanger 110. In some examples, absent implementation of one or more of the teachings disclosed herein (e.g., increased thickness/hardness of one or more portions of the body 304), this well pressure P might otherwise cause the second section 308 to "pull" on an area of the expandable liner hanger 110 comprising one or more of the anchoring ridges 202 (e.g., first section 206), thereby undermining the contact between that area of the expandable liner hanger 110 and the casing 125 and thus defeating the effectiveness of the expandable liner hanger 110. Specifically, by designing at least a portion of (e.g., all of) the second section 308 of the body 304 to be thicker and/or stiffer (e.g., more resistant to stress), deformation of the body 304 at the second section 308 will be reduced and thus prevent or mitigate "pulling" the first section 306 away from casing 125.

Thus, the second section 308 may resist stress applied thereto to a greater degree than the first section 306. This is achieved by increasing the yield strength and/or tensile strength of the material at second section 308 with respect to first section 306. Additionally, or alternatively, this is achieved by increasing the thickness of the body 304 at the second section 308, as mentioned. For example, the thickness of the body 304 at the second section 308 may be increased from about 5% to about 200% with respect to the body 304 at the first section 306. Alternatively, from about 5% to about 20%, about 20% to about 50%, about 50% to about 100%, about 100% to about 200%, or any ranges therebetween. Likewise, the yield strength and/or tensile strength of the material of which the body 304 at the second section 308 is increased with respect to the first section 306 may be from about 5% to about 200%, or any ranges therebetween, in some examples. Alternatively, or additionally, the body 304 at section 308 may be reinforced in other ways including, for example, an internal or external sleeve disposed at section 308, such as concentrically disposed around or within the body 304. Section 308 may be prepared using any suitable technique to change its strength characteristics. Increasing the yield strength and/or tensile strength of one or more portions of the body 304 may be performed using, for example and without limitation, local heat treatment, material selection, and other metallurgic/manufacturing techniques which would be readily apparent to one skilled in the art having the benefit of this disclosure.

Also visible in this figure is an expansion cone 310 which may include a cone mandrel 312 which may function, in some examples, to expand expandable liner hanger 110 to casing 125 as discussed above. During operations, force may be exerted on expandable liner hanger 110 by a cone mandrel 312 or similar device to drive anchoring ridges 202 into casing 125. This contact between anchoring ridges 202 allows expandable liner hanger 110 to be weight bearing. In examples where a collapsible cone 314 is used, it may function to reduce a force needed to pull expansion cone 310 out following expansion. For example, the outer diameter of collapsible cone 314 may be reduced to allow cone mandrel 312 to be removed during pull-out.

Figure 4:
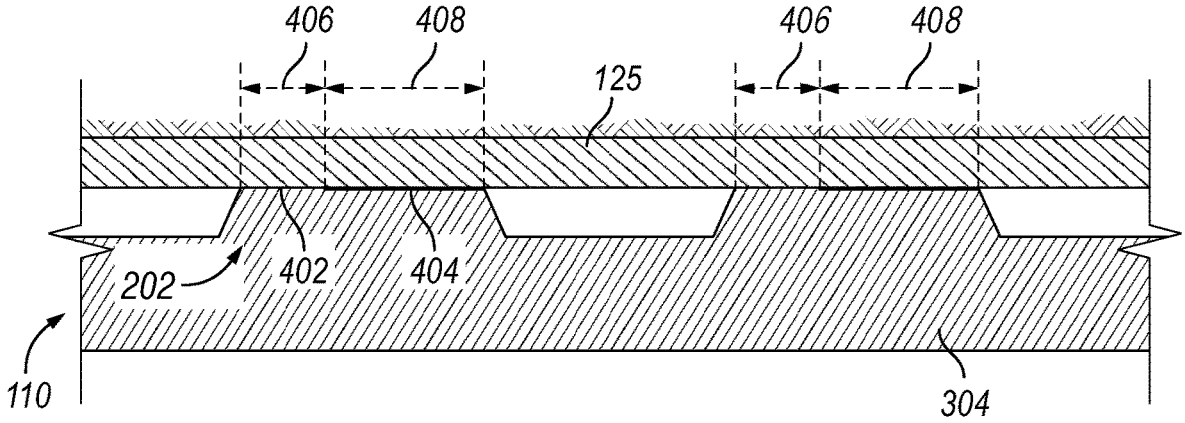
FIG. 4 illustrates a close-up view of an expandable liner hanger disposed in a casing, in accordance with one or more examples of the present disclosure.

FIG. 4 illustrates another close-up view of the expandable liner hanger 110 disposed in the casing 125, in accordance with examples of the present disclosure. This figure shows that, like in FIG. 3, designing targeted areas of the expandable liner hanger 110 (e.g., referring to FIG. 1) to be more or less deformable under strain ensures greater reliability and effectiveness of a seal between the expandable liner hanger 110 and the casing 125 by reducing the likelihood that the anchoring ridges 202 will become dislodged from casing 125 after setting of the expandable liner hanger 110 at a target depth in the wellbore. In this figure, each anchoring ridge 202 includes a sealing area 402 (sealing edge) disposed adjacent to a reinforced area 404 of each anchoring ridge 202. The reinforced area 404 is thicker and stiffer than the sealing area 402.

"Thickness" in this context refers to the relative lengths between first axial distance 406 and second axial distance 408. For example, second axial distance 408 may be from about 1.5 to about 10 times the first axial distance 406. Alternatively, from about 1.5 times to about 1.5 times, about 2.5 times to about 5 times, about 5 times to about 10 times, or any ranges therebetween. This increase in distance ensures that the contact area between the sealing area 402 and casing 125 is less affected by wellbore pressures P (e.g., referring to FIG. 3) or by pulling of the body 304 on one or more anchoring ridges 202 away from casing 125, thereby reducing the risk that the anchoring ridges 202 become dislodged from 125 casing following setting of the expandable liner hanger 110 at a target depth in the wellbore. Likewise, "stiffer" in this context refers to an increase in yield strength and tensile strength of the material at area 404 relative to sealing area 402. For example, a yield strength of area 404 may be greater than 5%, greater than 10%, greater than 15%, greater than 20%, greater than 30%, greater than 100%, greater than 200%, greater than 500%, or any ranges therebetween. Likewise, a tensile strength of area 404 may be greater than 5%, greater than 10%, greater than 15%, greater than 20%, greater than 30%, greater than 100%, greater than 200%, greater than 500%, or any ranges therebetween.

These differences in thicknesses and/or stiffness between reinforced area 404 and sealing area 402 may result in a reduction in the amount of force experienced by a given anchoring ridge 202 due to wellbore pressures P may by at least 5% with respect to an anchoring ridge without reinforcement, in some example. Alternatively, at least 10%, at least 15%, at least 25%, at least 50%, at least 100%, at least 200%, or any ranges therebetween, depending on the particular design of expandable liner hanger 110 and the wellbore conditions. Also, while not visible in the figure, sealing area 402 may have a stepped profile (e.g., stepped profile 500 of FIG. 5) to bite into casing 125, which may be at least partially flattened after running in hole and setting in the set position. Such deformation of a stepped profile may in some examples, enhance the metal-to-metal sealing performance of sealing area 402 with casing 125.

In this example, however, each anchoring ridge 202 is entirely flat and wide. Specifically, as opposed to a stepped design (e.g., anchoring ridge 202 of FIG. 5), the entirety of a given anchoring ridge 202 may be flat. "Wide" in this context refers to anchoring ridges which comprise sealing area 402 adjacent to reinforced area 404, whereas "flat" refers to the two-dimensional profile shown by this figure, whereby sealing area 402 is adjacent to, and flush with, reinforced area 404. Thus, these two areas may be flush with each other when in the RIH position, as well as flush with casing 125 when in the set position, as illustrated. In this example, the amount of deformation undergone at sealing area 402 during setting of expandable liner hanger 110 is minimal, such as by undergoing between about 0% to about 5% deformation between an RIH and set position, or any ranges therebetween. In examples, a substantial width, e.g., greater than 50%, 75%, 80%, entirety of, etc., the length spanned by both sealing area 402 and reinforced area 404 of one or more of anchoring ridge 202 may contact casing 125 at the interface between anchoring ridge 202 and casing 125 during the set position. As with previous figures, the specific geometry of wide spike 700 may enhance the metal-to-metal contact with casing 125.

Figure 5:
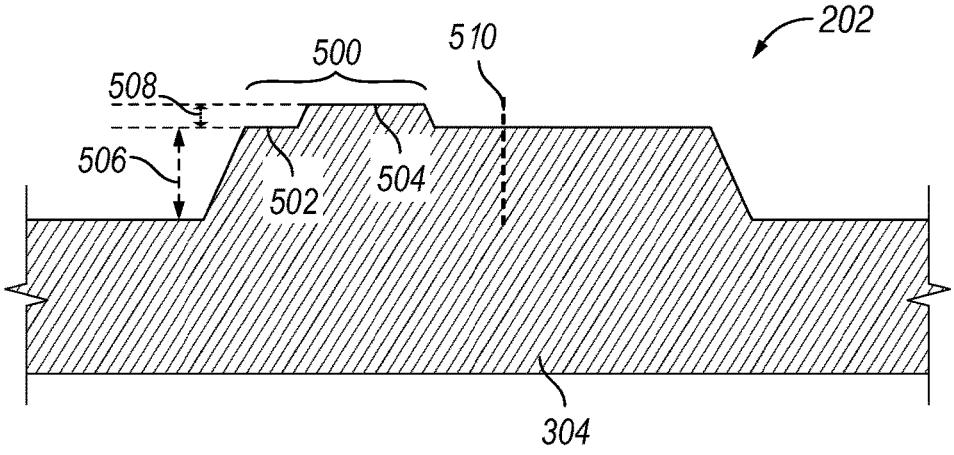
FIG. 5 illustrates anchoring ridge with a step profile, in accordance with one or more examples of the present disclosure.

FIG. 5 illustrates a close-up cross-sectional view of an anchoring ridge 202, in accordance with examples of the present disclosure. As mentioned, the anchoring ridge 202 may include a stepped profile 500 that includes a first step 502 extending radially outward from the body 304, and a second step 504 extending radially outward/protruding from the first step 502. A profile formed by the second step 504 step relative to the first step 502 may be characterized as trapezoidal as shown in the figure, however other geometries are possible. For example, second step 504 may be a rhombus, square, rectangle, round, or the like. This robust design may increase the local contact pressure at the region surrounding second step 504 and thus improve the metal-to-metal (MTM) sealing performance of expandable liner hanger 110. In examples, first radial distance 506 of first step 502 may be about 6 times that of second radial distance 508 of second step 504. Alternatively, from about 4 times to about 10 times as much, or any ranges therebetween. The specific dimensions of first step 502 and second step 504 may be associated with the advantages discussed herein, in some examples, i.e., the metal-to-metal sealing performance of expandable liner hanger 110. Without being limited to theory, it is believed that an amount of deformation undergone by second step 504 upon setting of expandable liner hanger 110 without disallowing at least a portion of first step 502 to contact casing 125 (e.g., referring to FIG. 1) may enhance the metal-to-metal contact of anchoring ridge 202, in some examples. For example, at least a portion of first step 502 on either side of, or both sides adjacent to, second step 504 may contact casing 125 (e.g., referring to FIG. 1) upon setting of expandable liner hanger 110, in some examples.

Ranges for axial distances spanned by for first and second steps 502, 504 in stepped profile examples may be comparable to those herein disclosed for sealing and reinforcement areas 402, 404. Namely, the axial distances spanned by the first steps may from about 1.5 times to about 1.5 times, about 2.5 times to about 5 times, about 5 times to about 10 times, or any ranges therebetween, the axial distance spanned by the second step. As illustrated, second step 504 may be biased above midline 510 so that it is positioned radially outwards from step 502 in an uphole direction, such that a substantial majority of first step 502 occupies space below second step 504. In some examples, this may allow select regions of first step 502 to be stiffer, to ensure good metal-to-metal contact with the second step 504 and the casing thereby reducing risk of dislodgement of anchoring ridge 202 from a wellbore casing. Alternative configurations are possible, however, such as by having second step 504 positioned at or below midline 510.

Figure 6:
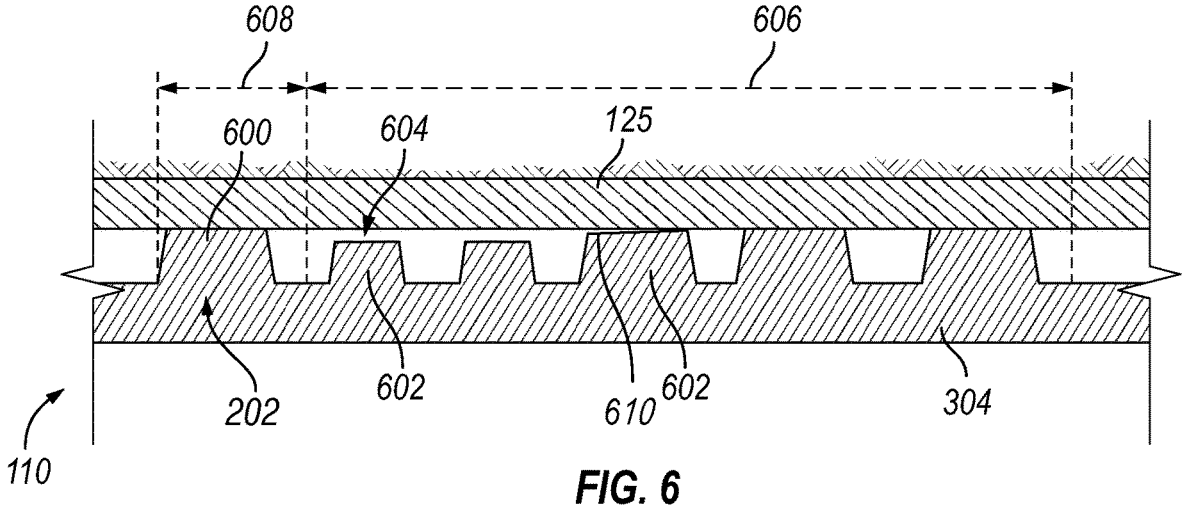
FIG. 6 illustrates a sealing spike and reinforcement spikes, in accordance with one or more examples of the present disclosure.

FIG. 6 illustrates another example anchoring ridge 202 of an expandable liner hanger 110. Anchoring ridge 202 may comprise a sealing spike 600, followed by a series of secondary, or reinforcement, spike(s) 602. A sealing spike 600 of anchoring ridge 202 creates the seal between the expandable liner hanger 110 and the casing 125, while the reinforcement spike(s) 602 provides the stiffness to the region around the sealing spike 600. The sealing spike 600 may be taller and wider than the reinforcement spike(s) 602 as illustrated. However, other configurations are possible, without departing from the spirit and scope of the disclosure, e.g., symmetrical, or roughly symmetrical geometric profiles between sealing spike 600 and reinforcement spike(s) 602. In the present example, the series of reinforcement spike(s) 602 reduces an expansion force required to expand the primary/sealing spike while achieving sufficient stiffness to resist differential pressure that reduces the primary spike contact pressure. The object of anchoring ridge 202 in this example is to ensure that contact pressure and thus metal-to-metal sealing performance is maximized, as previously discussed. Without limitation, gap 604 may exist between one or more of reinforcement spike(s) 602 and casing 125 which may be anywhere from about 0 millimeters to about 15 millimeters, or any ranges therebetween, when expandable liner hanger 110 is initially set in the set configuration. Where present, gap 604 may be formed as a result of using a taller sealing spike 600 than reinforcement spike(s) 602. By designing a taller sealing spike 600 and allowing there to be a gap 604, the metal-to-metal contact between anchoring ridge 202 may be maximized without interference from reinforcement spike(s) 602 adjacent thereto, while still preventing over-deformation of anchoring ridge 202 upon full expansion of the liner hanger 110 in the set position, e.g., by providing a 'stop' with the reinforcement spike(s) 602 adjacent to anchoring ridge 202 to limit over-expansion of expandable liner hanger 110. E.g., some or all of reinforcement spike(s) [604] 602 may seat against casing 125 upon full expansion of liner hanger 110 to prevent further deformation of sealing spike 600. This may serve to ensure the appropriate amount of contact pressure between casing 125 and anchoring ridge 202 is achieved without overly deforming anchoring ridge 202 beyond what is necessary to achieve sufficient contact with casing 125. Thus, such difference(s) in height(s) between anchoring ridge 202 and one or more adjacent reinforcement spike(s) 602 may cause one or more reinforcement spike(s) 602 neighboring that/those immediately adjacent to anchoring ridge 202 to have a slightly angled profile 610 relative to a longitudinal axis of casing 125 as illustrated, before, during, or after setting of the tool in the wellbore. Such angled profile 610 of one or more of reinforcement spike(s) 602 may be characterized by a slant angle of about 5 degrees from a longitudinal axis of a casing 125. Alternatively, from about 2 degrees to about 15 degrees, or any ranges therebetween. Similarly, where reinforcement spike(s) 602 comprise a plurality, an overall slant angle of the plurality may have these same ranges, in examples.

Reinforcement spike(s) 602 may be spaced apart, as illustrated, by distance(s) roughly equal to, greater to, or less than a width of one or more (e.g., all) of reinforcement spike(s) 602. Spacing in this manner may in some examples, enhance the metal-to-metal contact between sealing spike 600 and casing 125. Again, without being limited to one particular embodiment, the specific design of spacing between reinforcement spike(s) may materially affect the ability of expandable liner hanger 110 to appropriately engage casing 125 at anchoring ridge 202. For example, where reinforcement spike(s) 602 comprise a plurality (e.g., 2, 3, 4, 5, 6, etc.) of spikes, one or more (e.g., each) of the spikes may be separated by a distance from about 5 millimeters to about 200 millimeters, or any ranges therebetween. As with FIG. 5, any one or more of reinforcement spike(s) 602 may be stiffer than sealing spike 600. Similarly, an area comprising reinforcement spike(s) 602 may be thicker than sealing spike 600, for example, such that distance 606 is greater than distance 608. Each reinforcement spike(s) 602 may be of a standard, uniform length, or may have varying sizes.

Accordingly, the systems and methods of the present disclosure allow for the hanger to withstand extreme conditions such as high pressure and high temperature. The expandable liner hanger is a single body and is easy to manufacture and operate. The expandable liner hanger also has a higher anchor capability due to its high strength design. The expandable liner hanger is also more durable and reliable. The expandable liner hanger may be better equipped to be used in HTHP environments than conventional expandable liner hangers. Thus, the present disclosure may provide an expandable liner hanger and related apparatus, systems, and methods, which may have improved downhole reliability, and decreased risk of dislodgement from casing. The methods, systems, and tools may include any of the various features disclosed herein, including one or more of the following statements.

Statement 1: An expandable liner hanger comprising: a body that includes one or more anchoring ridges configured to seal against a casing, wherein at least one of the one or more anchoring ridge includes a first section and a second section, wherein a first axial distance spanned by the first section is less than a second axial distance spanned by the second section, and wherein the second section is reinforced to resist differential pressure that reduces contact pressure between the first section and the casing.

Statement 2: The expandable liner hanger of statement 1, wherein the second axial distance is at least 1.5 times the first axial distance.

Statement 3: The expandable liner hanger of statement 2, wherein the second axial distance is at least 3 times the first axial distance.

Statement 4: The expandable liner hanger of any of statements 1-3, wherein the second section has a yield strength of at least 175 ksi.

Statement 5: The expandable liner hanger of any of statements 1-4, wherein the first section is directly adjacent to the second section.

Statement 6: The expandable liner hanger of any of statements 1-5, further comprising: a run-in-hole configuration, wherein the first section includes a sealing area that extends along an edge of the anchoring ridge; and a set configuration, wherein an outer diameter of at least a portion of the expandable liner hanger is greater than that portion during the run-in-hole configuration, wherein the sealing area provides a contact area between the anchoring ridge and the casing.

Statement 7: The expandable liner hanger of statement 6, wherein in the run-in-hole configuration, the first section is flush with the second section.

Statement 8: The expandable liner hanger of statement 6, wherein in the run-in-hole configuration, the anchoring ridge comprises a first step extending radially outward from the first section, and a second step extending radially outward from the first step.

Statement 9: The expandable liner hanger of any of statement 8, wherein the first step extends radially outward from the first section by a first distance, wherein the second step extends radially outward from the first step by a second distance, and wherein the first distance is at least 5 times the second distance.

Statement 10: An expandable liner hanger comprising: a body that comprises one or more anchoring ridges each comprising a sealing area extending along a respective edge of the anchoring ridge and configured to seal against casing, wherein at least a portion of the body downhole to at least one sealing area of the one or more anchoring ridges is reinforced to resist differential pressure that reduces contact pressure between the one or more anchoring ridge and the casing.

Statement 11: The expandable liner hanger of statement 10, wherein the reinforced portion is directly adjacent to at least one of the one or more anchoring ridges.

Statement 12: The expandable liner hanger of statement 11, wherein the reinforced portion of the body is stiffer than at least a portion of each anchoring ridge.

Statement 13: The expandable liner hanger of statements 10-12, wherein the reinforced portion has a yield strength of at least 175 ksi.

Statement 14: The expandable liner hanger of any of statements 10-13, wherein a radial distance spanned by the reinforced portion is greater than a radial distance spanned by the body at each respective anchoring ridge.

Statement 15: The expandable liner hanger of any of statements 10-14, wherein an axial distance spanned by the reinforced portion is greater than an axial distance spanned by at least two anchoring ridges.

Statement 16: The expandable liner hanger of any of statements 10-15, wherein at least one of the one or more anchoring ridges comprises: a first step extending radially outward from the body; and a second step extending radially outward from the first step.

Statement 17: The expandable liner hanger of statement 16, wherein the first step extends radially outward from the body by a first distance, wherein the second step extends radially outward from the first step by a second distance, and wherein the first distance is at least 4 times the second distance.

Statement 18: The expandable liner hanger of any of statements 10-17, wherein at least one sealing area is flush with the reinforced portion.

Statement 19: An expandable liner hanger comprising: a body that includes a sealing spike followed by reinforcement spikes that extend along a length of the body, wherein the sealing spike is configured to seal against casing, wherein the reinforcement spikes are configured to reduce an expansion force required to expand the sealing spike while achieving sufficient stiffness to resist differential pressure that reduces contact pressure between the sealing spike and the casing.

Statement 20: The expandable liner hanger of statement 19, further comprising: a run-in-hole configuration; and a set position, wherein in the set position, there is a gap between the casing and the first reinforcement spike adjacent the sealing spike.

Although the present disclosure and its advantages have been described in detail, it should be understood that various changes, substitutions, and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. An expandable liner hanger comprising:

a body that includes one or more metal anchoring ridges configured to metal-to-metal seal against a casing comprising metal, wherein at least one of the one or more metal anchoring ridges includes a first section and a second section, each of the first section and the second section being metal, the first section comprising a sealing area configured to engage the casing to form the metal-to-metal seal, wherein a first axial distance spanned by the first section is less than a second axial distance spanned by the second section, wherein the second section is reinforced to resist reduction in contact pressure between the first section and the casing caused by wellbore pressure, wherein the sealing area comprises a stepped profile to enhance the metal-to-metal seal of the sealing area with the casing, and wherein the stepped profile is configured to bite into the casing.

2. The expandable liner hanger of claim 1, wherein the second axial distance is at least 1.5 times the first axial distance, and wherein the at least one of the one or more metal anchoring ridges comprises a metal spike.

3. The expandable liner hanger of claim 1, wherein the one or more metal anchoring ridges are machined metal anchoring ridges, wherein the second section reinforced to resist reduction in contact pressure between the first section and the casing comprises the second section having a yield strength of at least 175 kilopounds per square inch (ksi), and wherein the first section is directly adjacent to the second section.

4. The expandable liner hanger of claim 1, further comprising:

a run-in-hole configuration, wherein the sealing area extends along an edge of the metal anchoring ridge; and a set configuration, wherein an outer diameter of at least a portion of the expandable liner hanger is greater than that portion during the run-in-hole configuration, wherein the sealing area provides a contact area between the metal anchoring ridge and the casing.

5. The expandable liner hanger of claim 4, wherein in the run-in-hole configuration, the first section is flush with the second section.

6. The expandable liner hanger of claim 1, wherein the stepped profile comprises a first step extending radially outward from the first section, and a second step extending radially outward from the first step.

7. The expandable liner hanger of claim 6, wherein the first step extends radially outward from the first section by a first distance, wherein the second step extends radially outward from the first step by a second distance, and wherein the first distance is at least 5 times the second distance.

8. The expandable liner hanger of claim 1, wherein the at the least one of the one or more metal anchoring ridges is flat and does not have a stepped profile, and wherein the first section is flush with the second section.

9. The expandable liner hanger of claim 1, wherein the first section is flush with the second section.

10. An expandable liner hanger comprising:

a body that comprises one or more anchoring ridges comprising metal and each comprising a metal sealing area extending along a respective edge of the anchoring ridge and configured to seal against casing, wherein at least a portion of the body that is downhole from at least one metal sealing area of the one or more anchoring ridges is reinforced to resist differential pressure that reduces contact pressure between the one or more anchoring ridges and the casing, wherein an axial distance spanned by the reinforced portion is greater than an axial distance spanned by at least two of the one or more anchoring ridges, and wherein a radial distance spanned by the reinforced portion is greater than a radial distance spanned by the body at each respective anchoring ridge.

11. The expandable liner hanger of claim 10, wherein the reinforced portion is directly adjacent to at least one of the one or more anchoring ridges.

12. The expandable liner hanger of claim 10, wherein the reinforced portion of the body is stiffer than at least a portion of each anchoring ridge.

13. The expandable liner hanger of claim 12, wherein the reinforced portion has a yield strength of at least 175 ksi.

14. The expandable liner hanger of claim 10, wherein the one or more anchoring ridges are machined metal anchoring ridges.

15. The expandable liner hanger of claim 10, wherein at least one of the one or more anchoring ridges comprises:

a first step extending radially outward from the body; and a second step extending radially outward from the first step.

16. The expandable liner hanger of claim 15, wherein the first step extends radially outward from the body by a first distance, wherein the second step extends radially outward from the first step by a second distance, and wherein the first distance is at least 4 times the second distance.

17. An expandable liner hanger comprising:

a body that includes a sealing spike followed by reinforcement spikes that extend along a length of the body, wherein the sealing spike is configured to seal against casing, wherein the reinforcement spikes are configured to reduce an expansion force required to expand the sealing spike while achieving sufficient stiffness to resist differential pressure that reduces contact pressure between the sealing spike and the casing;

a run-in-hole configuration; and a set position, wherein in the set position, there is a gap between the casing and a reinforcement spike adjacent to the sealing spike.

* * * * *